United States Patent [19]

Libby

[11] Patent Number: 4,921,194

[45] Date of Patent: May 1, 1990

[54] MAIL BAG RACK

[76] Inventor: Roy Libby, 3025 Todd Dr., Madison, Wis. 53713

[21] Appl. No.: 381,362

[22] Filed: Jul. 18, 1989

Related U.S. Application Data

[63] Continuation-in-part of Ser. No. 207,239, Jun. 16, 1988, abandoned.

[51] Int. Cl.[5] ..... A63B 55/04

[52] U.S. Cl. ..... 248/97; 211/12; 248/100; 248/306; 248/341

[58] Field of Search ..... 248/97, 100, 95, 341, 248/306, 322; 211/12; 383/12, 33, 26

[56] References Cited

U.S. PATENT DOCUMENTS

| | | | |
|---|---|---|---|
| 28,024 | 4/1860 | Underkofler | 248/100 |
| 285,692 | 9/1883 | Sherman | 248/100 |
| 415,803 | 11/1889 | Weber | 248/97 |
| 426,778 | 4/1890 | Dalton | 248/322 |
| 609,589 | 8/1898 | Perkins | 248/100 |
| 1,018,637 | 2/1912 | Schults | 211/12 |
| 1,036,225 | 8/1912 | Hall | 248/95 X |
| 1,117,880 | 11/1914 | McMillin | 211/12 |
| 1,403,751 | 1/1922 | Edstrom | 248/97 |
| 1,694,079 | 12/1928 | Nicholas | 248/97 |
| 4,676,284 | 6/1987 | De Crane | 248/97 |

FOREIGN PATENT DOCUMENTS

| | | | |
|---|---|---|---|
| 604717 | 5/1960 | Italy | 211/12 |
| 358854 | 10/1931 | United Kingdom | 248/100 |

*Primary Examiner*—David L. Talbott
*Attorney, Agent, or Firm*—Keith Schoff

[57] ABSTRACT

To enable mail bags to be disengaged from a bag rack without lifting, bag hooks are provided with a constant radius curvature about a pivotal axis and are equipped with a handle for enabling them to be rotatively manually biased so that when used alone or in conjunction with fixed top bag supporting posts, a filled mail bag may be released from a bag rack and closed without requiring strenuous physical exertion on the part of a postal worker.

7 Claims, 1 Drawing Sheet

MAIL BAG RACK

FIELD OF ART

Postal workers are required to sort mail by placing individual pieces in a proper bag for the address location to which it is to be delivered.

BACKGROUND OF THE INVENTION

To assist postal workers in sorting mail, it has long been the practice to hang mail bags on a rack equipped with hooks placed to enable the bags to be supported with the tops open so that individual pieces of mail may be thrown into the bags quickly. However, to remove a bag from a rack for being closed and sealed, typically requires the full bag to be lifted from the hooks to free it from the rack. This is a continuation in part of Ser. No. 07/207,239 filed 6-16-88, now abandoned.

SUMMARY OF THE DISCLOSURE

A mail bag rack is provided with a substantially horizontally extending bar supported by upright legs which are elevationally adjustable to position the bar a comfortable working distance above a floor or working table. A series of hook means are hung on the bar to be rotatable around the axis of the bar, preferably in connected pairs with each pair provided with an upstanding handle and with the hook portion of each having a curvature substantially circumferentially arcuate to the axis of rotation of the hook means. Radially distant from each pair of hook means an upstanding support post may be provided preferably with with a topmost crosshead portion axially parallel to the bar and at lower levation than the bar and hook means. An empty mail bag is placed on the floor or working table with the open top extremity hooked by means of grommets or drawstring on the hook portions along a portion of the top edge and diametrically opposite the top edge of the bag is wrapped over the crosshead of the support post so that the bag is supported fully open for receiving mail with hook supported edge preferably being somewhat higher in elevation that the wrapped edge. A mail bag when supported in this manner when filled may be loosened from a mail rack by unwrapping the edge of the bag and pulling the handle of the hook means without requiring lifting or other strenuous exertion by a postal employee.

DESCRIPTION OF THE INVENTION

Figure 1:
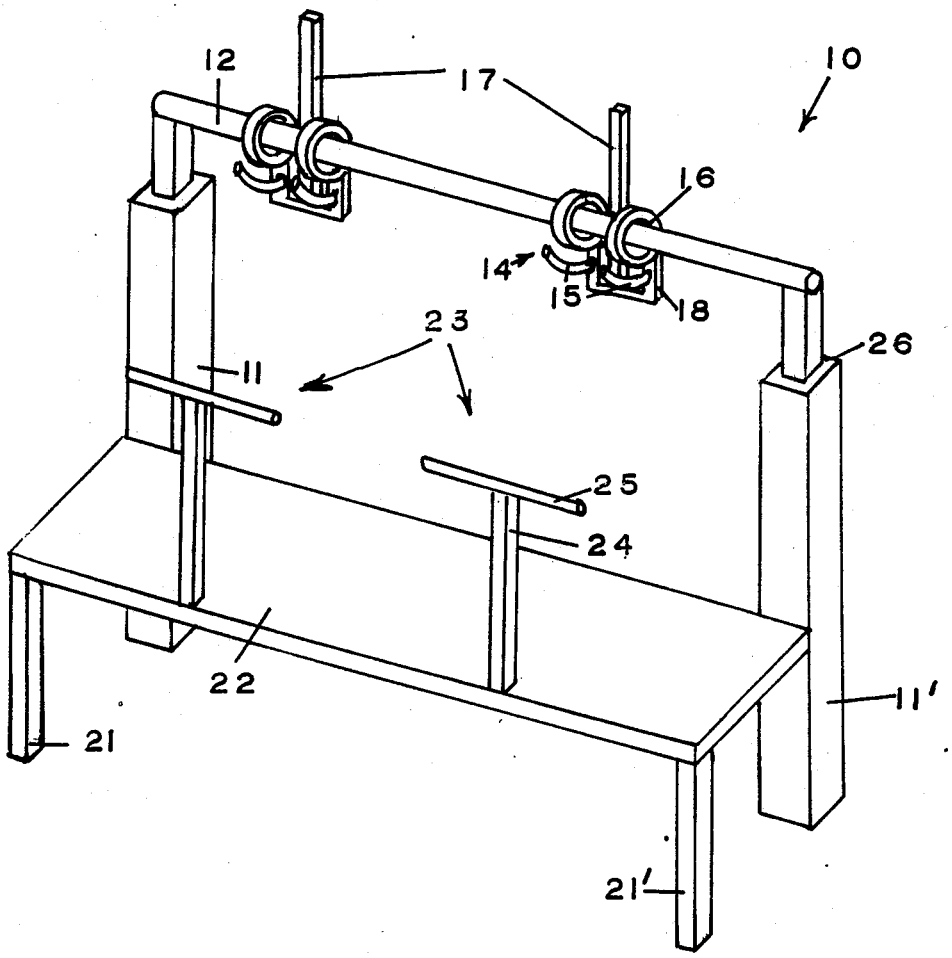
FIG. 1 is a perspective view of one embodiment of a mail bag rack of this invention.

Referring to FIG. 1, bag rack 10 embodies a first supporting standard comprising leg portions 11, 11' and axially-horizontal transverse bar 12. The leg portions are provided with telescoping joint 26 for making adjustment in the height of bar 12. As shown, bar 12 is of round cross section and carries two sets of mail bag hook means 14 which are rotatable coaxially with the bar. Any number of hook means may be provided on bar 12 and may comprise a single hook portion or three or more hook portions in each set as desired. As shown, each set comprises two identical ring 16 portions rigidly connected together by upstanding handle portion 17. Each ring 16 portion is configured with depending ear 18 and hook portion 15 having a curvature which is substantially circumferential to the axis of rotation of hook means 14. Weighting of hook means 14 is such that handle portion 17 extends upwardly in the position of rest for hook means 14 on bar 12 and hook portions 15 depend below said axis of rotation with said hook curvature extending at least slightly tilted upward above horizontal at the free ends. For releasing a mail bag operably suspended on hook means 14, a worker manually biases the handle to rotate hook means 14 and withdraw hook portions 15 from engagement with a mail bag without requiring the bag to be lifted or otherwise requiring significant physical exertion. Preferably, the edge of a bag is unfolded to free it from other support means before hook portions 15 are withdrawn.

A second supporting standard comprising leg portions 21, 21' support shelf 22 on which fixedly disposed post supports 23 are secured with the top of the supports terminating in crosshead portion 25. The crosshead portions are preferably at lower elevation than hook means 14 and are axially parallel to bar 12. As many post supports 23 may be provided on shelf 22 as desired and are preferably arranged with one post support for each mail bag provided on the bag rack. If desired, the post supports 23 may be substituted with apparatus similar to bar 12 and hook means 14.

A mail bag, not shown, is supported on mail bag rack 10 by the edge of a bag set on shelf 22 being folded over a crosshead portion 25 of one of post supports 23. Post portion 24 of the supports may be mounted on shelf 22 to be vertically adjustable, if desired. With the edge of an open top of a bag secured on post support 23, the opposite rear top edge of the bag can be hung on hook portions 15 of one of hook means 14 to maintain the bag in fully open position. Any desired number of bag stations may be provided along the length of bag rack 10 with the bags being individually removable by individual biasing of hook means 14 rotatively around bar 12. The bags are desirably hung on hook portions 15 by means of grommets or drawstring provided at the top edge of a mail bag. To remove a bag, the mounting procedure is reversed with the folded, front edge of the bar being removed first and the rear edge of the bag being thereafter disengaged from bag hook means 14 by biasing handle portion 17 manually. It is a preferred arrangement to provide a receptacle such as a bag cart immediately to the rear of rack 10 in contacting adjacency with the edge of shelf 22 and leg portions 11, 11' so that filled mail bags after being removed from engagement with post support 23 and hook means 14 may be closed and sealed and pushed from shelf 22 rearwardly over the edge of the shelf to fall into a mail cart, however, a mail cart is not shown in FIG. 1. The use of shelf 22 is optional, but preferred. Use of bag rack 10 enables postal workers to perform the often repeated routine procedure of sorting mail and depositing it in individual mail bags which, when filled are sealed without requiring lifting of filled bag from supporting hooks as required in conventional practice.

I claim:

1. A mail bag rack comprising in combination (a) a first fixed supporting standard having a substantially horizontal axial portion;

(b) at least one bag hook means rotatably mounted on said axial portion of said first supporting standard wherein hook curvature of said bag hook means substantially defines a circumferential arc coaxially with said axial portion, and wherein an extending handle portion is provided for rotative manual biasing of said bag hook means about said axial portion, and further wherein weighting of said hook means and said handle portion in a position of rest is such that said hook means depends below said axial portion with said hook curvature extending at least slightly upwardly tilted;

(c) at least one second fixed standard disposed to operably receive together with said bag hook means the upper extremity portion of an open mail bag for maintaining the bag in open position while it is being filled and for enabling the bag to be removed from said hook means without lifting by manual rotative biasing of said handle portion.

2. The apparatus of claim 1 wherein said bag hook means comprises a plurality of aligned hooks ganged together by one said handle portion.

3. The apparatus of claim 1 wherein said first fixed supporting standard is configured with upstanding leg portions fixedly connected to said substantially horizontal axial portion.

4. The apparatus of claim 1 wherein said second supporting standard is configured with an upstanding leg portion and a head portion laterally extending from the top of said leg portion.

5. The apparatus of claim 1 wherein said first and second supporting standards are maintained in fixed separation by interconnection therebetween.

6. The apparatus of claim 1 wherein a plurality of said bag hook means are rotatably mounted on said axial portion of said first supporting standard.

7. The apparatus of claim 1 wherein said first and second supporting standards are elevationaly adjustable with respect to each other.

* * * * *